US011504638B2

(12) United States Patent
Kim et al.

(10) Patent No.: US 11,504,638 B2
(45) Date of Patent: Nov. 22, 2022

(54) TOY ROBOT INCLUDING JOINT STRUCTURE

(71) Applicant: Dello Co., Ltd., Chungju-si (KR)

(72) Inventors: Dong Yoon Kim, Chungju-si (KR); Hee Dong Kim, Daejeon (KR)

(73) Assignee: DELLO CO., LTD., Chungju-si (KR)

( * ) Notice: Subject to any disclaimer, the term of this patent is extended or adjusted under 35 U.S.C. 154(b) by 0 days.

(21) Appl. No.: 17/475,608

(22) Filed: Sep. 15, 2021

(65) Prior Publication Data

US 2022/0126213 A1 Apr. 28, 2022

(30) Foreign Application Priority Data

Oct. 28, 2020 (KR) ..... 10-2020-0140877

(51) Int. Cl.
*A63H 3/46* (2006.01)
*A63H 9/00* (2006.01)

(52) U.S. Cl.
CPC ..... *A63H 3/46* (2013.01); *A63H 9/00* (2013.01)

(58) Field of Classification Search
CPC ... A63H 3/04; A63H 3/08; A63H 3/20; A63H 3/46; A63H 9/00; B25G 3/38; F16C 11/24
See application file for complete search history.

(56) References Cited

U.S. PATENT DOCUMENTS 1,387,097 A * 8/1921 Benton ..... A63H 3/36 446/376
3,659,309 A * 5/1972 Besnard ..... B60S 1/40 15/250.32
4,294,036 A * 10/1981 Wion ..... A63H 3/10 428/16
5,073,060 A * 12/1991 Pethers ..... B60S 1/3806 15/250.32
9,238,673 B2 * 1/2016 Steiner ..... A61P 43/00
2003/0077109 A1 * 4/2003 Chen ..... F16C 11/0619 403/52

* cited by examiner

*Primary Examiner* — John A Ricci
(74) *Attorney, Agent, or Firm* — LRK Patent Law Firm

(57) ABSTRACT

A toy robot includes a joint structure which includes first and second links and first and second connecting members, wherein each of the first and second links includes a central region and a pair of sidewall regions that are bent to extend to the left and right of the central region, and the pair of sidewall regions face each other. A first one of the sidewall regions of the first link and a second one of the sidewall regions of the second link partially overlap, the first connecting member includes a first shaft penetrating the overlapping region of the first and second sidewall regions, a third one of the sidewall regions of the first link and a fourth one of the sidewall regions of the second link partially overlap, the second connecting member includes a second shaft penetrating the overlapping region of the third and fourth sidewall regions.

9 Claims, 9 Drawing Sheets

TOY ROBOT INCLUDING JOINT STRUCTURE

CROSS-REFERENCE TO RELATED APPLICATION

This application claims priority to Korean Patent Application No. 10-2020-0140877, filed on Oct. 28, 2020, the entire content of which is hereby incorporated by reference.

BACKGROUND

1. Technical Field

Embodiments disclosed in this document relate to a toy robot.

2. Description of Related Art

The toy robot can be made by imitating a shape or movement of a human or animal's body. For example, in order to reproduce a body part having joints such as a human arm and leg, the toy robot may have a joint structure.

The parts included in the toy robot can be made of various materials such as metal, plastic, and paper. If the prefabricated parts are made of solid materials such as metal and plastic, durability of a complete robot can be guaranteed after assembly by designing a coupling structure of each part precisely. However, if the parts are made of a material that can be easily deformed even with a small force, such as paper, a technology that allows the complete robot to rigidly maintain its completed form after the parts are assembled is needed.

SUMMARY

If the parts of the toy robot are made of paper, a raw material price becomes cheaper. In addition, since the parts themselves are light in weight, there is an advantage in that the weight of the toy robot itself is also lightened. However, paper parts lack rigidity as they can be easily bent or deformed. Therefore, a design to compensate for the shortcomings of these parts and to maintain rigidity of the complete robot is needed.

The toy robot according to an embodiment disclosed in this document may include a joint structure. The joint structure comprises a first link and a second link, and a first connecting member and a second connecting member that connect the first link and the second link so that the first and second links are rotatable, and each of the first link and the second link comprises a central region and a pair of sidewall regions that are bent to extend to the left and right of the central region, and the pair of sidewall regions may face each other. A first sidewall region of the pair of sidewall regions of the first link and a second sidewall region of the pair of sidewall regions of the second link at least partially overlap, the first connecting member comprises a first shaft penetrating the overlapping region of the first sidewall region and the second sidewall region, a third sidewall region of the pair of sidewall regions of the first link and a fourth sidewall region of the pair of sidewall regions of the second link at least partially overlap, the second connecting member comprises a second shaft penetrating the overlapping region of the third sidewall region and the fourth sidewall region, and the first link and the second link may be configured to rotate about the first shaft and the second shaft.

BRIEF DESCRIPTION OF THE DRAWINGS

In connection with the description of the drawings, the same or similar reference numerals may be used for the same or similar components.

DETAILED DESCRIPTION OF THE INVENTION

Hereinafter, various embodiments of the present invention will be described with reference to the accompanying drawings. However, this is not intended to limit the present invention to specific embodiments, and it should be understood that various modifications, equivalents, and/or alternatives of the embodiments of the present invention are included.

Figure 1:
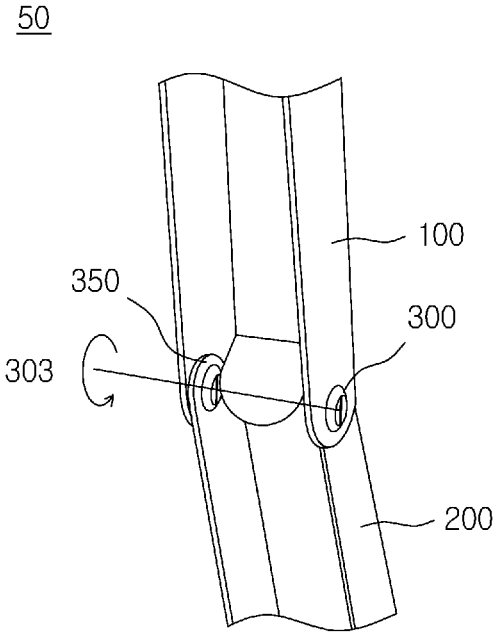
FIG. 1 illustrates a joint structure included in a toy robot according to an embodiment.
Figure 2:
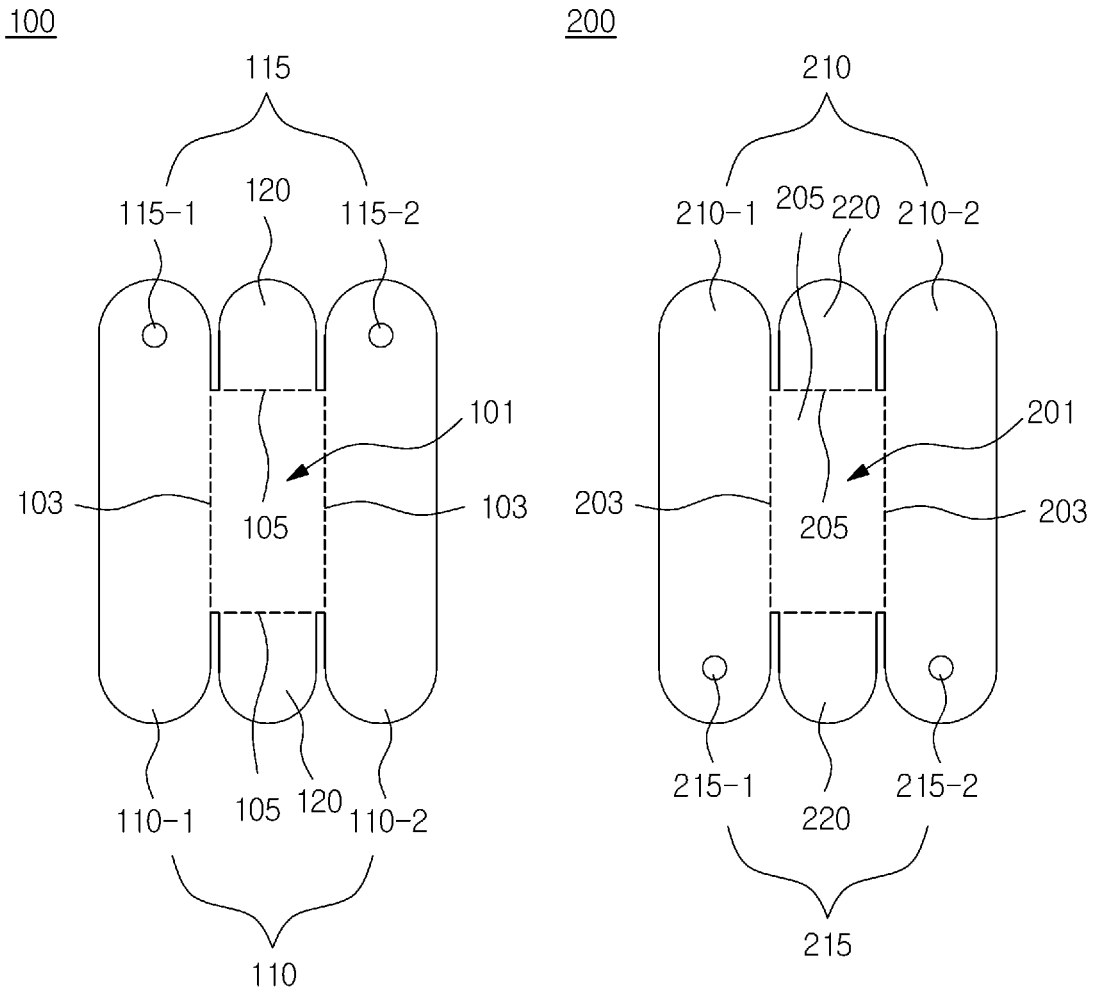
FIG. 2 illustrates perspective views of links included in the joint structure according to an embodiment.

FIG. 1 illustrates a joint structure included in a toy robot according to an embodiment. FIG. 2 illustrates perspective views of the links included in the joint structure according to an embodiment. Hereinafter, the joint structure of the toy robot will be described with reference to FIGS. 1 and 2.

The toy robot may refer to, for example, a robot-shaped toy. The toy robot may include a joint structure 50 in an embodiment. The joint structure 50 may be understood as a structure for reproducing the joint structure of a human or an animal. For example, the joint structure 50 may constitute a portion that can be bent similarly to a human body, such as a human arm or leg.

In an embodiment of the present invention, a link may be understood as a part constituting the joint structure 50 of the toy robot. The link may be, for example, a part made of a paper material. The links may be assembled while being bent or bent to constitute the joint structure 50 of the toy robot. Links may be bent according to guide lines (dotted lines) shown for reference in the links. The links may be coupled with other links in a bent form to form the joint structure. As an example of the link, a first link 100 and a second link 200 of FIG. 2 are illustrated. In this specification, the link may be referenced as various types of links exemplified throughout the specification.

The joint structure 50 may include the first link 100, the second link 200, and at least one connecting member connecting the first link 100 and the second link 200 so that the first link 100 and the second link 200 rotate.

In an embodiment, a first connecting member 300 and a second connecting member 350 may connect the first link 100 and the second link 200 to be rotatable. The first link 100 and the second link may form a rotating axis 303.

For example, the connecting member may include a shaft parallel to the rotating axis 303. The shaft may include rod-shaped metal or rod-shaped plastic.

The first link 100 and the second link 200 may be made of a paper material. For example, the links may be made of various paper materials such as manila paper, ivory paper, corrugated paper, gang paper, hard board paper, and eco-friendly paper.

In an embodiment, the first link 100 may comprise a first region 101 and a pair of first extension regions 110 that are bent to extend from each of a pair of parallel first edges 103 of the first region 101. The pair of first extension regions 110 may face each other.

In FIG. 2, a case in which the first link 100 has the same structure as the second link 200 is illustrated, for example. The first region 101 of the first link 100 may correspond to a second region of the second link 200. The pair of first extension regions 110 of the first link 100 may correspond to a pair of second extension regions 210 of the second link 200. However, various links to be described later in this specification may be coupled to each other to constitute a coupling structure.

In an embodiment, the first link 100 and the second link 200 may be connected such that the pair of first extension regions 110 and the pair of second extension regions 210 at least partially overlap. For example, a 1-1 extension region 110-1 of the pair of first extension regions 110 and a 2-1 extension region 210-1 of the pair of second extension regions 210 may partially overlap. A 1-2 extension region 110-2 of the pair of first extension regions 110 and a 2-2 extension region 210-2 of the pair of second extension regions 210 may partially overlap.

In various embodiments, the first region 101 and the second region 201 are disposed parallel to each other, and may be disposed on a straight line or disposed at positions facing each other. For example, the 1-1 extension region 110-1 and the 2-2 extension region 210-2 may partially overlap, and the 1-2 extension region 110-2 and the 2-1 extension region 210-1 may partially overlap.

In an embodiment, the first connecting member 300 may include a first shaft parallel to the rotating axis 303. The second connecting member 350 may include a second shaft parallel to the rotating axis 303. The first shaft of the first connecting member 300 may penetrate a region where the 1-1 extension region 110-1 and the 2-1 extension region 210-1 overlap. The second shaft of the second connecting member 350 may penetrate a region where the 1-2 extension region 110-2 and the 2-2 extension region 210-2 overlap. In this case, the first link 100 and the second link 200 may rotate around the first shaft and the second shaft.

In an embodiment, a pair of first openings 115 formed through which the first connecting member 300 penetrates may be formed in the pair of first extension regions 110 of the first link 100. A pair of second openings 215 formed through which the second connecting member 350 penetrates may be formed in the pair of second extension regions 210 of the second link 200.

In an embodiment, the pair of first openings 115 and the pair of second openings 215 may be at least partially aligned when viewed in the extension direction of the rotating axis 303. For example, the pair of first openings 115 and the pair of second openings 215 may be disposed so that at least some portions thereof overlap. The first connecting member 300 and the second connecting member 350 may connect the first link 100 and the second link 200 through the overlapping regions of the openings.

In an embodiment, the first connecting member 300 may be disposed by penetrating the opening 115-1 and the opening 215-1 to connect the 1-1 extension region 110-1 and the 2-1 extension region 210-1. The second connecting member 350 may be disposed by penetrating the opening 115-2 and the opening 115-2 to connect the 1-2 extension region 110-2 and the 2-2 extension region 210-2.

The first region 101 may include the pair of first edges 103 and a pair of third edges 105 perpendicular thereto. The second region 201 may include a pair of second edges 203 and a pair of fourth edges 205 perpendicular thereto.

In an embodiment, the first link 100 may include a pair of third extension regions 120 that are bent to extend from the pair of parallel third edges 105 of the first region 101. The pair of third extension regions 120 may face each other. The second link 200 may include a pair of fourth extension regions 220 that are bent to extend from the pair of parallel fourth edges 205 of the second region 201. The pair of fourth extension regions 220 may face each other.

The pair of third extension regions 120 are bent to extend from, so that the pair of third extension regions 120 may have a lateral force with respect to the first region 101. Therefore, the first region 101 may be supported taut without being bent. The pair of fourth extension regions 220 are bent to extend from the second region 201, so that the pair of fourth extension regions 120 may have a lateral force with respect to the second region 201. Therefore, the second region 101 may be supported taut without being bent. In one example, when the first link 100 and the second link 200 are made of a paper material, the pair of third extension regions 120 and the pair of fourth extension regions 220 may help to make the joint structure 50 rigid.

In various embodiments, the first region 101 may be referenced as a central region of the first link. The pair of first extension regions 110 may be referenced as a pair of sidewall regions that are bent to extend to the left and right of the central region. A first sidewall region of the pair of sidewall regions of the first link and a second sidewall region of the pair of sidewall regions of the second link may at least partially overlap. The first connecting member may include a first shaft penetrating the overlapping region of the first sidewall region and the second sidewall region. A third sidewall region of the pair of sidewall regions of the first link and a fourth sidewall region of the pair of sidewall regions of the second link may at least partially overlap, and the second connecting member may include a second shaft penetrating the overlapping region of the third sidewall region and the fourth sidewall region. The first link and the second link may be configured to rotate about the first shaft and the second shaft.

Figure 3A:
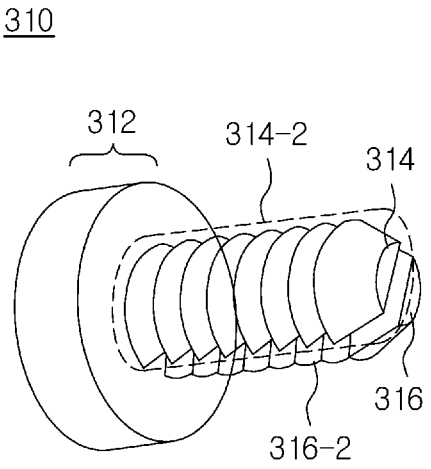
FIG. 3A is a configuration diagram of a bolt included in a connecting member according to an embodiment.
Figure 3B:
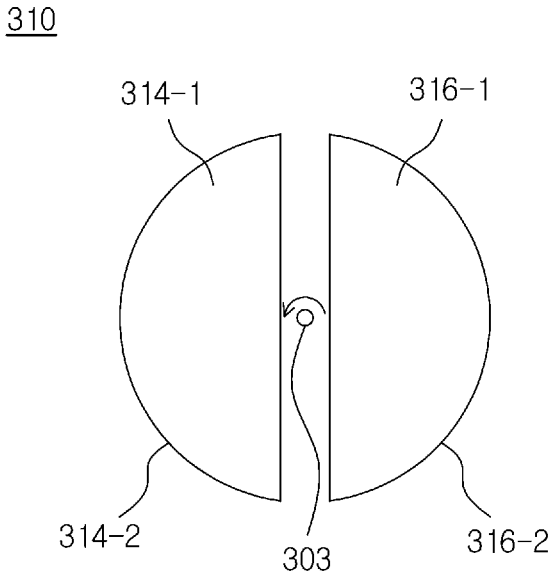
FIG. 3B is a cross-sectional view of the bolt included in a connecting member according to an embodiment.
Figure 3C:
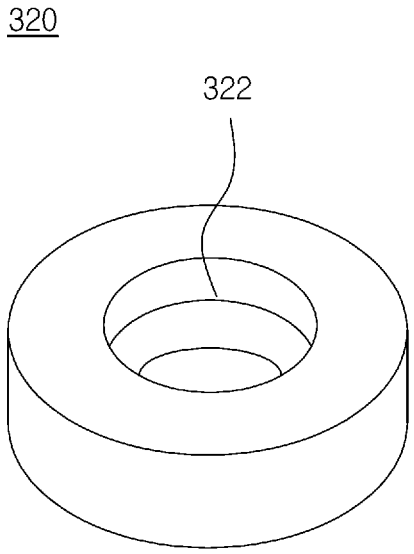
FIG. 3C is a configuration diagram of a nut included in a connecting member according to an embodiment.
Figure 3D:
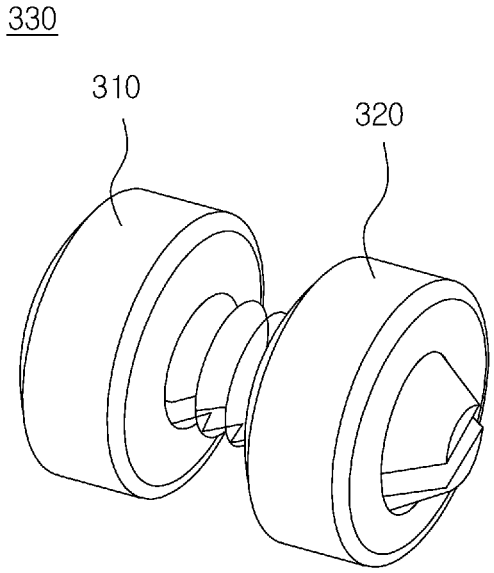
FIG. 3D is a diagram illustrating a configuration of a connecting member in which the bolt and the nut are coupled according to an embodiment.

FIG. 3A is a configuration diagram of a bolt included in the connecting member according to an embodiment. FIG. 3B is a cross-sectional view of the bolt included in the connecting member according to the embodiment. FIG. 3C is a configuration diagram of a nut included in the connecting member according to an embodiment. FIG. 3D illustrates a configuration diagram the connecting member in which the bolt and the nut are coupled according to an embodiment. Hereinafter, a connecting member (e.g., the first connecting member 300, the second connecting member 350 of FIG. 1) according to an embodiment will be described with reference to FIGS. 3A to 3D.

In an embodiment, the first connecting member 300 may include a bolt 310 and a nut 320 fastened to the bolt 310. For example, the first shaft of FIG. 1 may be referenced as the bolt 310 parallel to the rotating axis 303 of the first link 100 and the second link 220.

In an embodiment, the bolt 310 may include a head 312, and a first bolt region 314 and a second bolt region 316 extending from one surface of the head 312. The first bolt region 314 and the second bolt region 316 may extend from one surface of the head 312 in the direction of the rotating axis 303 of the joint structure 50. The direction of the rotating axis 303 may be parallel to a normal vector of one surface of the head 312. In various embodiments, the rotating axis 303 may pass through the center of the head 312.

In this case, the first link 100 and the second link 200 may be configured to rotate around the first bolt region 314 and the second bolt region 316 of the bolt 310. The first bolt region 314 and the second bolt region 316 may be spaced apart from each other by a prescribed distance with the rotating axis 303 interposed therebetween. The first bolt region 314 and the second bolt region 316 may be formed to be deformable so that the prescribed distance approaches or moves away from each other.

Referring to FIG. 3B, the first bolt region 314 and the second bolt region 316 may respectively have arc-shaped cross sections 314-1 and 316-1, which have the rotation axis 303 as a center, when viewed in a cross section perpendicular to the rotation axis 303.

In an embodiment, each of the first bolt region 314 and the second bolt region 316 has the same radius around the rotating axis 303 when viewed in the cross section perpendicular to the rotating axis 303.

Referring to FIGS. 3A and 3B, the first bolt region 314 may include a first arcuate surface 314-2 having the rotating axis 303 as a center. The second bolt region 316 may include a second arcuate surface 316-2 having the rotating axis 303 as a center.

In an embodiment, a protruding portion extending in a circumferential direction of the rotating axis 303 and protruding in a radial direction of the rotating axis 303 may be formed on each of the first arc surface 314-2 and the second arc surface 316-2. The protruding portion may include a plurality of protruding portions spaced apart from each other at regular distances in the direction of the rotating axis. In this case, the protruding portion extending to the first arc surface 314-2 and the protruding portion extending to the second arc surface 316-2 may be continuous.

Referring to FIG. 3C, the nut 320 according to an embodiment may form a groove 322 in which the protruding portion is accommodated on an inner circumferential surface 322. Any one of the plurality of protrusions included in the bolt 310 and the groove 322 of the nut 320 may be fastened to form a connecting member 330 of FIG. 3D (e.g., the first connecting member 300 of FIG. 1).

For example, the protruding portions of the bolt 310 may be respectively disposed at regular distances rather than spiral. In this case, the groove 322 of the nut 320 may be fastened to any one of the plurality of protruding portions.

In one example, the inner radius of the nut 320 may be equal to the radius of the first arc surface 314-1 of the first bolt region 314 or the radius of the second arc surface 316-1 of the second bolt region 316.

In an embodiment, the bolt 310 and the nut 320 may be made of an eco-friendly material such as polyethylene (PE), Ecozen, etc. in addition to a general metal material.

Figure 4A:
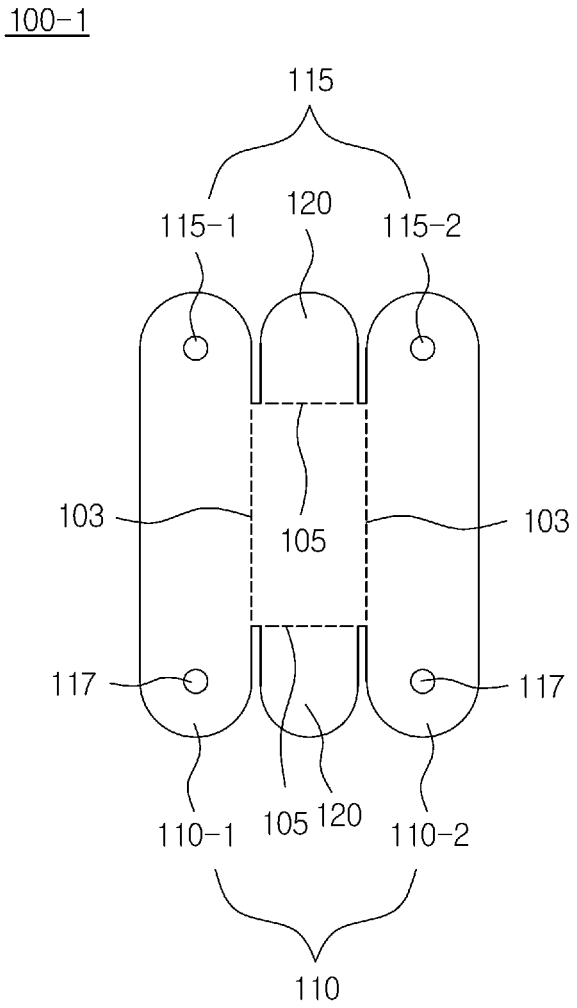
FIGS. 4A to 4C are perspective views of links included in the joint structure according to various embodiments.
Figure 4B:
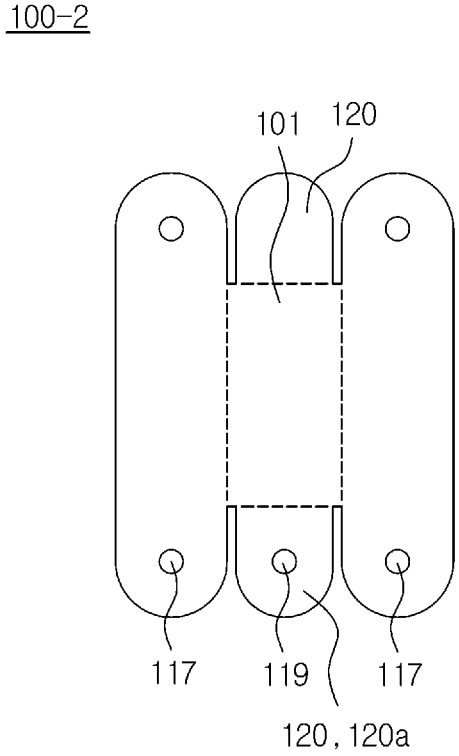
Figure 4C:
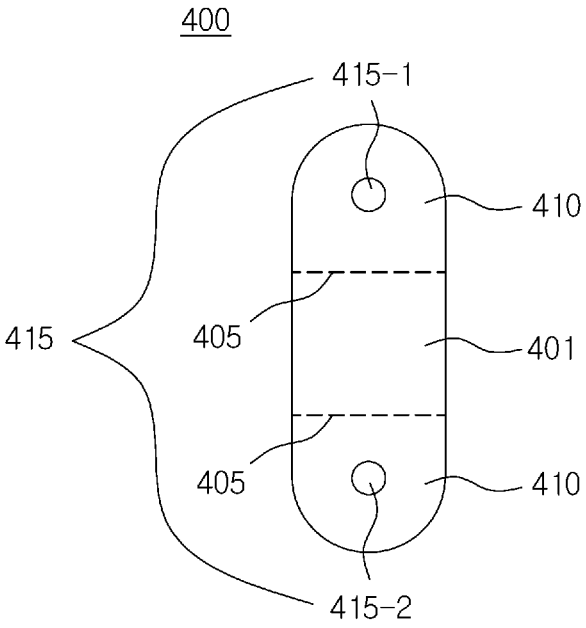
Figure 5:
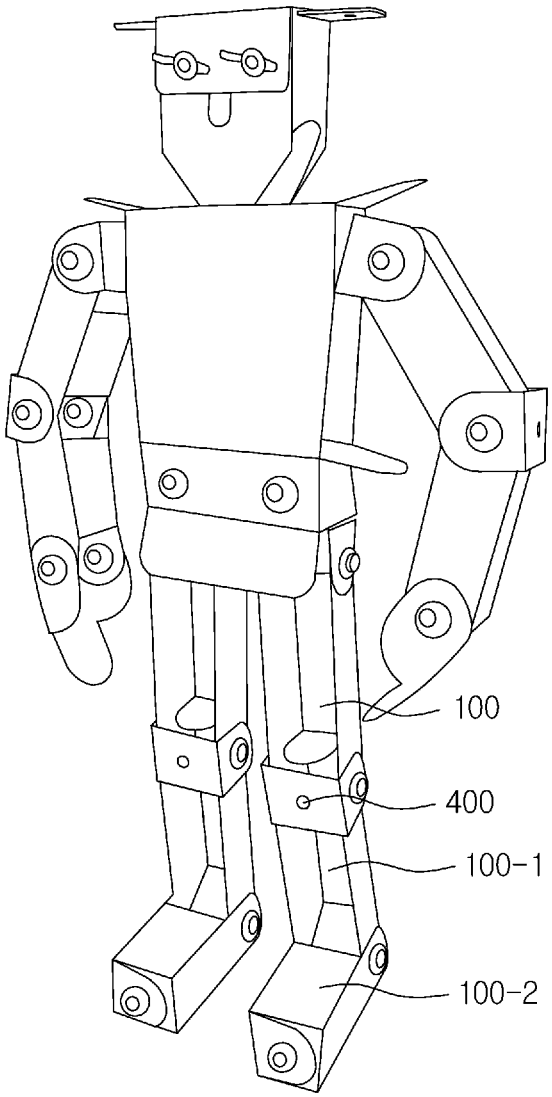
FIG. 5 illustrates a shape of a toy robot according to an embodiment.

FIGS. 4A to 4C are perspective views of the links included in the joint structure according to various embodiments. FIG. 5 illustrates a shape of a toy robot according to an embodiment. The toy robot of FIG. 5 is an example in which links according to various embodiments are coupled.

A link 100-1 of FIG. 4A and a link 100-2 of FIG. 4B may be modified forms of the first link 100 and the second link 200 of FIG. 1. Hereinafter, the portion corresponding to the first link 100 of FIG. 1 refer to the reference numerals described above in FIG. 1.

Referring to FIG. 4A, the pair of first extension regions 110 of the link 100-1 may further include a pair of third openings 117. It may be connected to another link (e.g., the first link 100, the second link 200 of FIG. 2) through connecting members (e.g., the first connecting member 300 of FIG. 1) that penetrate the pair of third openings 117. The link 100-1 and another link may be configured to rotate around the connecting member. For example, the first link 100 and the second link 200 of FIG. 2 may further include another pair of openings corresponding to the pair of third openings 117. Through the other pair of openings 117, it may be further connected to another link.

Referring to FIG. 5, when the second link 200 of FIG. 2 further comprises the pair of openings 117, it may be referenced as the link 100-1. In this case, the second link 200 may be further connected to the other link 100-2 through the pair of openings.

Referring to FIG. 4B, one extension region 120*a* of the pair of third extension regions 120 of the link 100-2 may further include a fourth opening 119. The fourth opening 119 may be disposed so that at least some portions thereof overlap the pair of third openings 117. In this case, it may be connected by the connecting member (e.g., the first connecting member 300 of FIG. 1) penetrating the fourth opening 119 and the pair of third openings 117.

The link 100-2 may be coupled with other links in the form illustrated in FIG. 5. For example, the link 100-2 may constitute an end of the toy robot. The link 100-2 may constitute a foot and a hand of the toy robot.

Referring to FIG. 4C, a link 400 may include a fifth region 401, and a pair of fifth extension regions 410 that respectively are bent to extend from a pair of parallel fifth edges 405 of the fifth region 401. The pair of fifth extension regions 410 may face each other. A pair of fifth openings 415 may be formed in the pair of fifth extension regions 410. The pair of fifth extension regions 410 may apply a lateral force to the fifth region 401 to make the fifth region 401 taut and rigid.

For example, the pair of fifth openings 415 may be disposed to overlap the pair of first openings 115 of the first link 100 of FIG. 1 and the pair of second openings 215 of the second link 200 of FIG. 1. Referring to FIG. 2, the first connecting member 300 may penetrate the opening 115-1, the opening 215-1, and an opening 415-1. The second connecting member 350 may penetrate the opening 115-2, the opening 215-2, and an opening 415-2.

Referring to FIG. 5, the link 400 may be disposed between the first link 100 and the link 100-1 (e.g., the second link 200 of FIG. 2). When viewed from the front of the toy robot, the fifth region 401 may be disposed to cover a region where the first link 100 and the link 100-1 are connected. The link 400 may make the joint structure 50 of the toy robot rigid and visually express the joint portion.

If the links of the toy robot are made of a paper material, paper has a tendency to unfold. Referring to FIG. 1, each of the regions 110-1 and 110-2 of the pair of first extension regions 110 is likely to spread laterally. Each of the regions 210-1 and 210-2 of the pair of second extension regions 210 is likely to spread laterally. This is because the respective regions are respectively connected by the first connecting member 300 and the second connecting member 350. In this case, the above phenomenon can be improved by connecting the link 400 with the first link 100 and the second link 100-2.

Figure 6A:
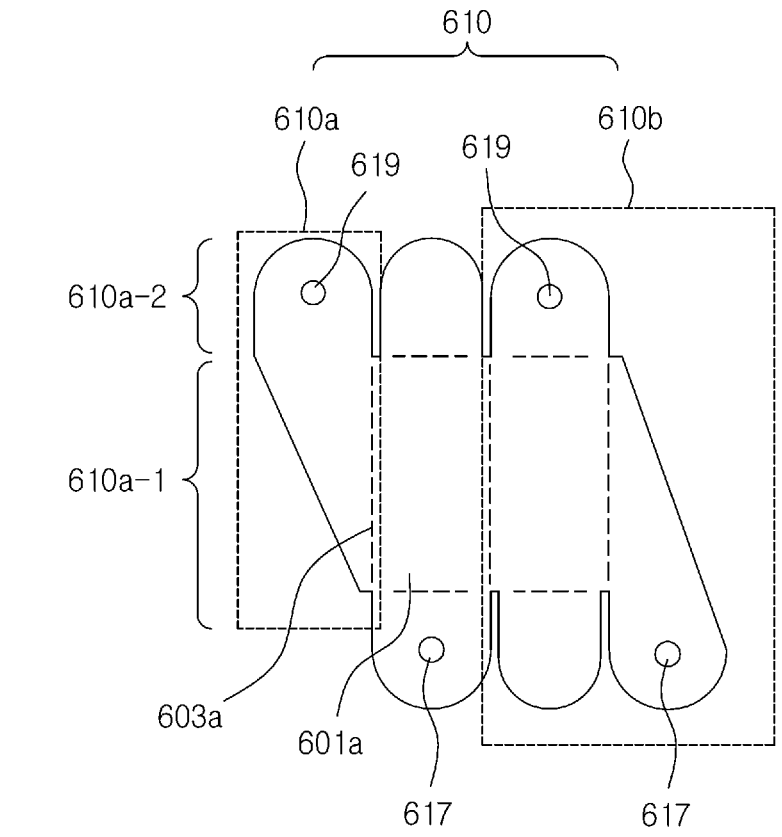
FIG. 6A is a perspective view of a link of the toy robot according to an embodiment.
Figure 6B:
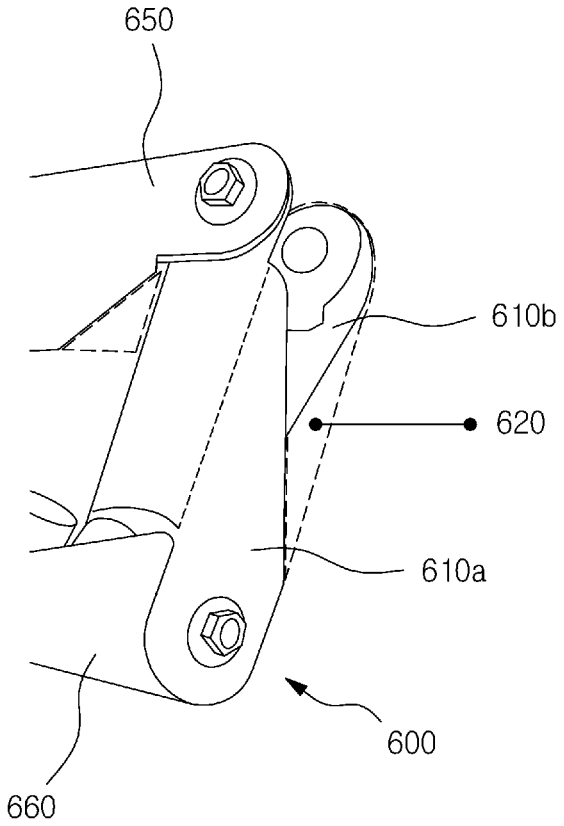
FIG. 6B is a structural diagram illustrating when the link of FIG. 6A is connected to another link.

FIG. 6A is a perspective view of a link of the toy robot according to an embodiment. FIG. 6B is a structural diagram illustrating when the link of FIG. 6A is connected to another link.

Referring to FIG. 6A, the link constituting the toy robot (e.g., the first link 100 and the second link 200 of FIG. 1) may be in the form of a link 600. For example, the pair of first extension regions 110 of the first link 100 may be referenced as a pair of extension regions 610 of the link 600.

The link 600 may be coupled with the other link in a bent state according to the guide line displayed on the link 600. The openings included in the link 600 may be understood as connecting portions for coupling with the other link. The link 600 and the other link connected thereto may be configured to rotate the connecting member coupled to the openings (e.g., the connecting member 300 of FIG. 1) around the rotating axis (e.g., the rotating axis 303 of FIG. 1).

One extension region 610*a* of the pair of extension regions 610 of the link 600 may extend from one end of an edge 603*a* of the link 600 (e.g., any one of the pair of first edges 103 of the first link 100 of FIG. 1), and one extension region 610*a* of the pair of extension regions 610 may include a triangular region 610*a*-1 having the edge 603*a* as one side and another region 610*a*-2 extending from the triangular region 610*a*-1. An opening (e.g., any one of the pair of openings 115 of the first link 100 of FIG. 1) may be formed in the other region 610*a*-2.

One of the pair of extension regions 610 of the link 600 may correspond to any one of the pair of extension regions 110 of the first link 100 of FIG. 1. For example, the extension region 610*a* may correspond to the 1-1 extension region 110-1 of the pair of extension regions 110 of FIG. 1, and an extension region 610*b* may correspond to the 1-2 extension region 110-2 of the pair of extension regions 110.

Referring to FIG. 6B, the shape when the link 600 is bent is illustrated. The triangular region 610*a*-1 of the region 610*a*-1 of the link 600 may form a space for rotation of the link 600 and the other link 650. When the link 600 is bent, it constitutes a shape of a rectangular parallelepiped, and two consecutive surfaces of the four surfaces may include a surface of a triangular shape to configure the space of the rotation.

Referring to FIG. 6B, the region 610*a* and the region 610*b* of the link 600 may be configured to secure a space 620 for rotation of the link 600 and the other link 650 when the link 600 is bent and coupled with the other link 650. For example, when the link 600 is bent, the region 610*a* and the region 610*b* may include a triangular-shaped surface. At least a portion of the region 610*a* and the region 610*b* is configured in a triangular shape instead of a quadrangle, so that the space 620 for rotation may be secured.

For example, the triangular-shaped surface 610*a*-1 of the region 610*a* may secure a rotation region with the link to be connected through the openings 617. The triangular-shaped surface of the region 610*b* may secure a rotation region with the link to be connected through the openings 615.

Referring to FIG. 6B, an example in which two different links 650 and 660 are connected to the link 600 is illustrated. For example, the link 650 is connected to the openings 617, and the link 660 is connected to the openings 619 located opposite to the openings 617. In this case, the link 600 and the first rotating axis of the link 650, and the second rotating axis of the link 600 and the link 660 may be perpendicular to each other. A first rotating axis of the link 600 and the link 650 and a second rotating axis of the link 600 and the link 660 may be perpendicular to each other.

In particular, the link 600 may be made of a paper material, and may constitute a portion of the toy robot in a bent or bent state according to the guide line shown in the link 600. In this case, even if the link 600 has a tendency to unfold due to the characteristics of paper, the assembled state can be stubbornly maintained by forming the first rotating axis and the second rotating axis perpendicular to each other. Accordingly, by coupling the link 600 with the other links 650 and 660, the assembled state of the link 600 may be rigidly maintained.

According to the embodiments disclosed in this document, it is possible to ensure the rigidity of the toy robot by assembling paper parts lacking in rigidity through the joint structure of the toy robot. In addition, the joint structure may allow the toy robot to reproduce the movement of a human or an animal. In addition, various effects directly or indirectly identified through this document may be provided.

Various embodiments of this document and terms used therein are not intended to limit the technical features described in this document to specific embodiments, but it should be understood to include various modifications, equivalents, or alternatives of the embodiments. In connection with the description of the drawings, like reference numerals may be used for similar or related components. The singular form of the noun corresponding to an item may include one or more of the items, unless the relevant context clearly dictates otherwise. As used in this document, each of the phrases such as "A or B", "at least one of A and B", "at least one of A or B," "A, B or C," "at least one of A, B, and C", and "at least one of A, B, or C" may include all possible combinations of items listed together in the corresponding one of the phrases. Terms such as "first", "second", or "firstly" or "secondly" may simply be used to distinguish a component from other components, and do not limit the components in other respects (e.g., importance or order).

What is claimed is:

1. A toy robot including a joint structure, wherein the joint structure comprises a first link and a second link, and a first connecting member and a second connecting member that connect the first link and the second link so that the first and second links are rotatable, each of the first link and the second link comprises:

a central region, and a pair of sidewall regions that are bent to extend to the left and right of the central region, the pair of sidewall regions facing each other, a first sidewall region of the pair of sidewall regions of the first link and a second sidewall region of the pair of sidewall regions of the second link at least partially overlap, the first connecting member comprises a first shaft penetrating the overlapping region of the first sidewall region and the second sidewall region, a third sidewall region of the pair of sidewall regions of the first link and a fourth sidewall region of the pair of sidewall regions of the second link at least partially overlap, the second connecting member comprises a second shaft penetrating the overlapping region of the third sidewall region and the fourth sidewall region, and the first link and the second link are configured to rotate about the first shaft and the second shaft.

2. The toy robot of claim 1, wherein:

a first opening formed through which the first shaft penetrates is formed in the first sidewall region;

a second opening formed through which the first shaft penetrates is formed in the second sidewall region;

the first opening and the second opening are at least partially aligned when viewed in an extension direction of the first shaft;

a third opening through which the second shaft penetrates is formed in the third sidewall region;

a fourth opening through which the second shaft penetrates is formed in the fourth sidewall region; and the third opening and the fourth opening are at least partially aligned when viewed in an extension direction of the second shaft.

3. The toy robot of claim 1, wherein:

the first shaft and the second shaft form a rotating axis of the first link and the second link;

the first shaft comprises a first bolt parallel to the rotating axis;

the first connecting member comprises a first nut fastened to the first bolt;

the second shaft comprises a second bolt parallel to the rotating axis; and the second connecting member comprises a second nut fastened to the second bolt.

4. The toy robot of claim 3, wherein:

each of the first and second bolts comprises a head, and a first bolt region and a second bolt region extending from one surface of the head along the direction of the rotating axis; and the first bolt region and the second bolt region are spaced apart from each other by a prescribed distance with the rotating axis interposed therebetween.

5. The toy robot of claim 4, wherein the first bolt region and the second bolt region are formed to be deformable so that the prescribed distance approaches or moves apart.

6. The toy robot of claim 1, wherein each of the first link and the second link comprises a pair of other sidewall regions that are bent to extend upward and downward of the central region, the pair of other sidewall regions facing each other.

7. The toy robot of claim 6, wherein the pair of sidewall regions and the pair of other sidewall regions are perpendicular to each other.

8. The toy robot of claim 1, further comprising:

a third link, wherein the third link comprises a first region, and a pair of sidewall regions that are bent to extend to the left and right of the first region, the pair of sidewall regions facing each other;

the first sidewall region, the second sidewall region, and a fifth sidewall region of the pair of sidewall regions of the third link at least partially overlap;

the first shaft penetrates the overlapping region of the first sidewall region, the second sidewall region, and the fifth sidewall region;

the third sidewall region, the fourth sidewall region, and a sixth sidewall region of the pair of sidewall regions of the third link at least partially overlap; and the second shaft penetrates the overlapping region of the third sidewall region, the fourth sidewall region, and the sixth sidewall region.

9. The toy robot of claim 1, wherein the first link and the second link are made of paper material.

* * * * *